US006931817B2

(12) United States Patent
Reed

(10) Patent No.: US 6,931,817 B2
(45) Date of Patent: Aug. 23, 2005

(54) AUTOMATIC GROCERY BAG OPENER

(76) Inventor: Dale Reed, 351 E. Civic Center Dr. #1006, Gilbert, AZ (US) 85296

( * ) Notice: Subject to any disclaimer, the term of this patent is extended or adjusted under 35 U.S.C. 154(b) by 19 days.

(21) Appl. No.: 10/072,178

(22) Filed: Jun. 24, 2002

(65) Prior Publication Data

US 2005/0102974 A1 May 19, 2005

(51) Int. Cl.[7] ..... B65B 41/00

(52) U.S. Cl. ..... 53/385.1; 53/571; 53/572; 53/570; 53/384.1; 53/52

(58) Field of Search ..... 53/385.1, 384.1, 53/52, 570, 571, 572

(56) References Cited

U.S. PATENT DOCUMENTS 3,138,907 A * 6/1964 Gerbe ..... 53/385.1
3,673,767 A * 7/1972 Hutchinson ..... 53/385.1
3,678,652 A * 7/1972 Panasewicz ..... 53/385.1
3,727,374 A * 4/1973 Williams ..... 53/385.1
3,754,342 A * 8/1973 Santacroce et al. ..... 53/385.1
3,897,676 A * 8/1975 Membrino ..... 53/385.1
4,085,822 A * 4/1978 Osborn ..... 53/385.1
4,567,715 A * 2/1986 Sawa et al. ..... 53/572
5,442,898 A * 8/1995 Gabree et al. ..... 53/385.1
5,485,714 A * 1/1996 Montalvo ..... 53/459
5,974,685 A * 11/1999 Hironaka ..... 34/202
5,992,430 A * 11/1999 Chardack et al. ..... 134/115 G

* cited by examiner

*Primary Examiner*—John Sipos
*Assistant Examiner*—Michelle Lopez
(74) *Attorney, Agent, or Firm*—Schmeiser, Olsen & Watts LLP

(57) ABSTRACT

An automatic grocery bag opener automatically opens plastic and polyethylene bags with forced air in produce departments and at checkout counters of grocery stores. Bags are held in position from any of several different types of hangers on the front of the enclosure. The outside bag is forced and held open by the forced airstream from the air supply. The bag can then be filled with the grocery items. Once the bag is filled, it is removed from the hangers and the next bag is automatically blown and held open. As long as the motion sensor sees movement, the blower stays on. If no movement is seen by the motion sensor, the motion sensor ends an electric signal, thus turning off the blower. In turn, if the motion sensor sees a motion, an electric signal is sent to the blower and turns the bagger back on.

2 Claims, 1 Drawing Sheet

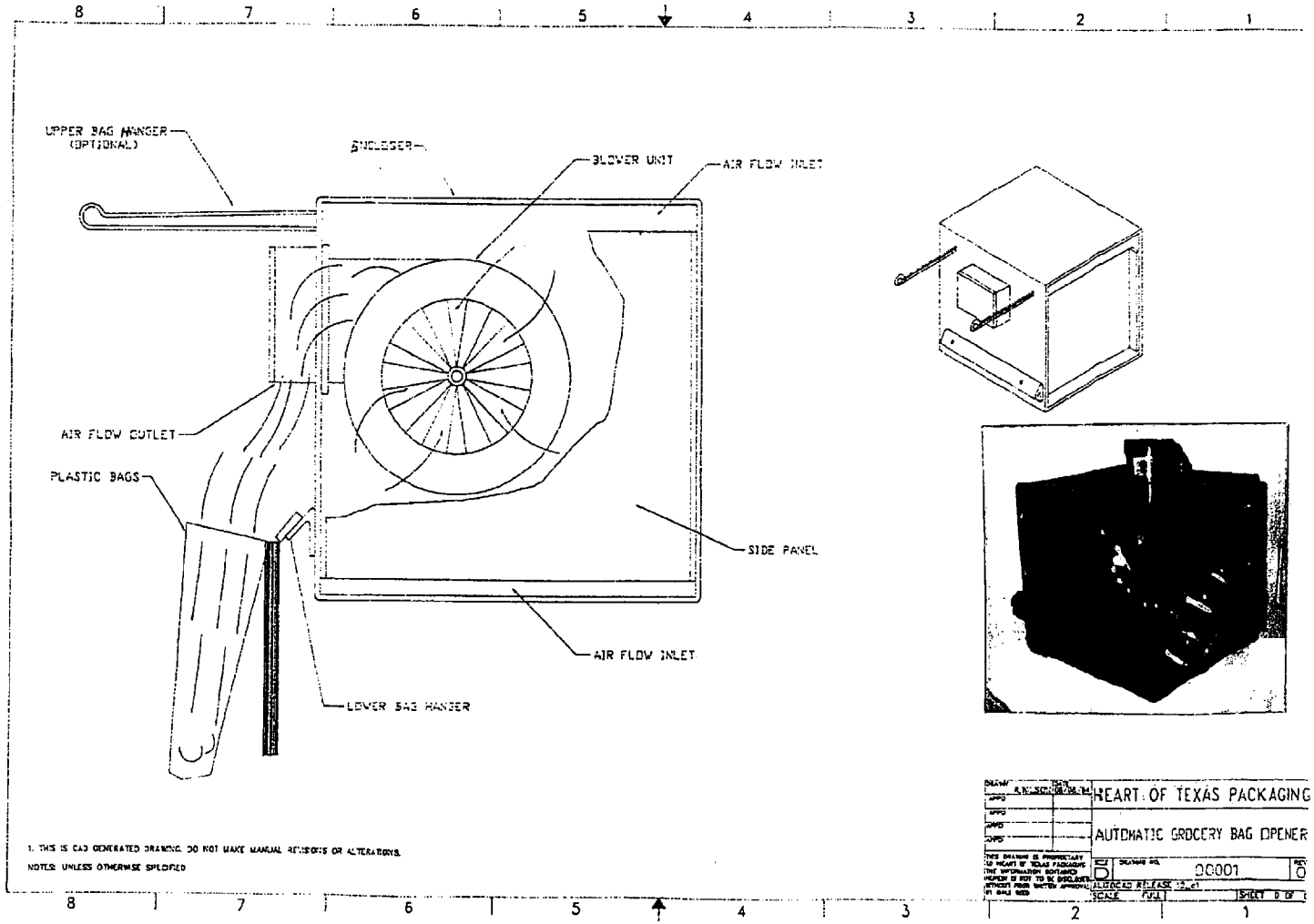
HEART OF TEXAS PACKAGING
AUTOMATIC GROCERY BAG OPENER
AIR FLOW INLET
BLOWER UNIT
SIDE PANEL
AIR FLOW INLET
ENCLOSER
LOWER BAG HANGER
UPPER BAG HANGER (OPTIONAL)
AIR FLOW OUTLET
PLASTIC BAGS
NOTES UNLESS OTHERWISE SPECIFIED

AUTOMATIC GROCERY BAG OPENER

BACKGROUND OF THE INVENTION

1. Technical Field

This invention generally relates to a plastic bag dispensers, and in particular to produce or grocery bag dispensers that facilitate opening of a bag to be filled with groceries.

2. State of the Art

Devices of the past include bag holders and dispensers that are combined with other support structures such as checkout stands or other cabinet structures. Some devices of the past are complex, having extensive automation for filling bags with products and for moving the bags once filled, for example. Other bag dispensing devices are simple and require user manipulation for operation and/or adjustment.

DISCLOSURE OF THE INVENTION

The present invention relates to a device which is used to automatically open plastic and polyethylene bags with forced air in produce departments and at checkout counters of grocery stores. The device also automatically turns on and off depending on a detected presence of a user. Hence, the present invention overcomes the deficiencies of the past by providing a standalone device that is not necessarily combined with other structures, such as cabinets. Furthermore, the present invention has automation in which other simpler devices of the past are deficient. That is the present invention automatically turns on and off and automatically opens the first bag in a stack of grocery bags to be dispensed.

The foregoing and other features and advantages of the present invention will be apparent from the following more detailed description of the particular embodiments of the invention, as illustrated in the accompanying drawings.

BRIEF DESCRIPTION OF THE DRAWINGS

FIG. 1 is a partial sectional side view according to an embodiment of the present invention.

DETAILED DESCRIPTION OF EMBODIMENTS OF THE INVENTION

As discussed above, embodiments of the present invention relate to an automatic bag opener and dispenser.

As shown in FIG. 1, bags are held in position from several different types of hangers on a front of an enclosure (D). The outside bag is forced and held open by the forced airstream from the air supply. The bag can then be filled with the items. Once the bag is filled, it is removed from the hanger. The next bag is automatically blown and held open. By switching on, the feed through cord switch (A) starts the shaded pole blower (B) to force the air flow (C) out of the bagger enclosure (D) to open plastic or polyethylene bags located on the lower bag holder (B) on the front of the bagger Enclosure (D). Additionally or alternatively, the front can have another upper bag holder or hanger supported on an upper portion of the front as shown in FIG. 1. As long as the motion sensor (F) sees movement the shaded pole blower (B) stays on. If no movement is seen, the motion sensor (F) sends an electric signal to a time delay relay (G) plugged into a relay socket (H) turning off the shaded pole blower (B). In turn, if the Motion Sensor (F) sees motion of a person walking up to or near the Motion Sensor (F), the Time Delay Relay (G) sends an electric signal to the shaded pole blower (B) turning the Bagger back on and making the bagger an automatic bagging system.

Additional details are incorporated herein by reference to Disclosure Document No. 496447. This document has been included for convenience in an appendix.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. An automatic bag opener and dispenser, comprising:

an enclosure having a front face, a top, a bottom, sides, and a back surrounding an interior of the enclosure;

an upper bag hanger comprising a pair of forwardly extending arms supported on an upper portion of the front face and a lower bag hanger supported on a lower portion of the front face of the enclosure respectively for hanging bags on said upper and lower hangers;

a first opening in the front face for passage of blowing air out of the enclosure;

at least one second opening in the enclosure for passage of air drawn into the enclosure;

a blower unit supported on the interior of the enclosure and configured to draw air form the at least one second opening and to force air from the first opening on the front face;

an airflow outlet guide on the front face in superposed relation to the first opening, the airflow outlet having a first guide wall substantially parallel to the front face mounted on the front face and configured to direct the blowing air at a bag opening; and a motion sensor mounted on the top of the enclosure and operably connected to the blower unit to automatically turn on the blower unit when motion of a user is sensed by the motion sensor when the user approaches the bag opener and dispenser.

2. An automatic bag opener and dispenser, comprising;

an enclosure having a front face, a top, a bottom, sides, and a back surrounding an interior of the enclosure;

an upper bag hanger comprising a pair of forwardly extending arms supported on an upper portion of the front face and a lower bag hanger supported on a lower portion of the front face of the enclosure respectively for hanging bags on said upper and lower hangers;

a first opening in the front face for passage of blowing air out of the enclosure;

at least one second opening in the enclosure for passage of air drawn into the enclosure;

a blower unit supported on the interior of the enclosure and configured to draw air from the at least one second opening and to force air from the first opening on the front face, and an airflow outlet guide on the front face in superposed relation to the first opening, the airflow outlet having a first guide wall substantially parallel to the front face, the outlet guide being mounted on the front face and configured to direct the blowing air at a bag opening; and an air flow guide mounted on the front face and configured to direct the blowing air at a front bag opening, wherein the air flow guide has a second guide wall fixedly supported at an acute angle on the front face and extending away from the airflow outlet and toward a plane of the first guide wall; and a motion sensor mounted on the top of the enclosure and operably connected to the blower unit to automatically turn on the blower unit when motion of a user is sensed.

* * * * *